US005386077A

United States Patent [19]

Cuthill et al.

[11] Patent Number: 5,386,077

[45] Date of Patent: Jan. 31, 1995

[54] METHOD FOR REMOVING RADIOACTIVE SCALE FROM FLUID CARRYING EQUIPMENT

[76] Inventors: Trevor F. Cuthill, 1533-Windsor Street, N.W., Calgary, Alberta, Canada, T2N 3X2; John G. DeCook, P.O. Box 41099, Edmonton, Alberta, Canada, T6J 6M7

[21] Appl. No.: 14,515

[22] Filed: Feb. 8, 1993

[51] Int. Cl.[6] ..... G21F 9/00

[52] U.S. Cl. ..... 588/1; 134/4; 134/8; 134/17; 976/DIG. 376

[58] Field of Search ..... 134/2, 4, 8, 17; 976/DIG. 376, DIG. 391; 588/1

[56] References Cited

U.S. PATENT DOCUMENTS

| | | | |
|---|---|---|---|
| 3,934,379 | 1/1976 | Braton et al. | 51/319 |
| 3,948,679 | 4/1976 | Lewis | 134/10 |
| 4,409,034 | 10/1983 | Williams | 134/4 |
| 4,491,484 | 1/1985 | Williams | 134/4 |
| 4,493,999 | 1/1985 | Catchen | 250/260 |
| 4,503,577 | 3/1985 | Fowler | 15/88 |
| 4,554,025 | 11/1985 | Burke et al. | 134/17 |
| 4,595,419 | 6/1986 | Patenaude | 134/1 |
| 4,621,652 | 11/1986 | Ozawa | 134/95 |
| 4,705,574 | 11/1987 | Burckhardt et al. | 134/17 |
| 5,028,273 | 7/1991 | Weltmer, Jr. et al. | 134/42 |
| 5,081,068 | 1/1992 | Endo et al. | 437/225 |
| 5,085,709 | 2/1992 | Morris et al. | 134/3 |
| 5,091,034 | 2/1992 | Hubert | 156/344 |

OTHER PUBLICATIONS

Peter Gray and Associates, The Norm Report, Naturally Occurring Radioactive Material Contamination in the Petroleum Industry, Spring/Summer 1992, Box 342, Bartlesville, Okla. 74005, 8 pages.

A. L. Smith, Radioactive-Scale Formation, Journal of Petroleum Technology, Jun. 1987, pp. 697–706.

Radioactive materials could pose problems for the gas industry, Peter Gray, Jun. 25, 1990, Oil and Gas Journal, pp. 45–48.

Chemical Abstract, CA103 (24):19751y, 1985.

*Primary Examiner*—Ngoclan T. Mai

*Attorney, Agent, or Firm*—Anthony R. Lambert

[57] ABSTRACT

A method for removing radioactive barium sulphate from fluid carrying equipment includes immersing the equipment and scale in liquid nitrogen or other cyrogenic liquid, followed by immersing the equipment and scale in water or other aqueous solution, and subsequent impacting of the equipment and scale to remove the scale.

20 Claims, No Drawings

METHOD FOR REMOVING RADIOACTIVE SCALE FROM FLUID CARRYING EQUIPMENT

FIELD OF THE INVENTION

This invention relates to the removal of radioactive material from fluid carrying equipment, particularly equipment used in the oil industry.

BACKGROUND AND SUMMARY OF THE INVENTION

Radioactive barium sulphate is found in many subterraneum oil and gas deposits in small quantities. Over a period of years, radioactive barium sulphate gradually becomes coated onto the inside surfaces of tubulars (pipes), flanges, valves and related fluid carrying equipment used in extracting oil and gas from subterraneum deposits. The radioactive barium sulphate forms a scale on the inside of the fluid carrying equipment that in a 4½" OD, 4" ID pipe may be an inch thick or more, almost completely blocking the pipe. Such a pipe becomes useless for the transportation of fluid, and must be disposed of.

Before such a pipe or other fluid carrying equipment contaminated with radioactive barium sulphate scale may be disposed of, for example in underground storage, the regulations of some jurisdictions require that the radioactive scale be removed. Radioactive barium sulphate contains radium 226 which is a dirty isotope with a half life of 1600 years. If ingested, inhaled or absorbed into human tissue, it ends to migrate directly to the lymph glands or bone marrow and cause cancer. A safe procedure for the removal of scale is far more important than recovery or utilizing the equipment after cleaning. This is a unique and difficult problem in that the dimensions of the fluid carrying equipment vary in size greatly and operative equipment such as valves are difficult to access in order to clean them One way of removing the scale is to use a rotary scraping tool that bores out the pipe, but this method tends to cause hazardous radioactive dust to form, even when the equipment and environment is wetted. Because of the hazard caused by the formation of radioactive dust, workers must use specialized protective clothing and use remote air supplies when working to remove radioactive scale using a boring process. Also, the method is inapplicable to valves, and useful only for tubulars having constant diameter. Another way to remove the radioactive scale is to apply ethylenediaminetetraacetic acid to the scale, but this too has limited success. Other ways include percussion hammering and use of extreme high pressure water, but neither are particularly useful for valves and both methods are time consuming, expensive and require hazardous equipment. Both dry and high pressure water cleaning tend to carry minute radioactive dust particles that are potentially very hazardous to the worker's health.

The inventor has provided a completely new method of removing radioactive scale from fluid carrying equipment that includes, according to one aspect of the invention, initially cryogenically treating the equipment, followed by applying an aqueous solution to the scale and subsequently impacting the equipment to remove the scale. The preferred aqueous fluid is water, and it is believed to be advantageous to apply hot water to the scale.

DETAILED DESCRIPTION OF PREFERRED EMBODIMENTS

In the preferred method of carrying out the invention, the fluid carrying equipment, with the scale on it, is immersed in liquid nitrogen and cooled until the equipment and scale is stabilized at about minus 190° C. Stabilization occurs when the liquid nitrogen stops bubbling furiously. The fluid carrying equipment is then immersed in water until a layer of ice several millimeters thick forms around the scale and the equipment. Next, the equipment is impacted to remove the scale from the equipment. The scale will typically fragment into chunks of scale sized from ½" cubes to 1/32" cubes.

The liquid nitrogen will of course be kept in a vessel and if necessary (which will usually be the case) the equipment is first cut into sizes appropriate for the vessel using conventional methods. Liquid nitrogen is not mandatory, but while other cryogenic liquids may be used, is preferred for its ease of availability and non-toxicity. It is also not necessary that water be used. It is believed that any liquid having a freezing point substantially higher than the temperature to which the equipment is cooled would be useful, but it would be foolhardy to use a toxic or expensive liquid when water is cheap and adequate for the purpose. The water, or other aqueous liquid, is believed to be absorbed by pores in the scale, which facilitates the break up of the scale. In a test for water and oil saturation of two barium sulphate pipe samples, it was found that water saturation increased from 0.009 (dry scale) to 0.012 (cryogenically treated scale), oil from 0.004 to 0.007, and solids decreased from 0.991 to 0.979 (with a discrepancy of 0.006 (dry) and 0.002 (treated). The discrepancy is equal to 1−(oil+water+solids). Porosity of the samples was 0.078 (dry) and 0.082 (treated), yielding saturation based on measured pore volume for water of 0,408 (dry) and 0,537 (treated) and for oil of 0,204 (dry) and 0.327 (treated).

The water, besides facilitating the break up of the scale, keeps the volume of dust in the environment to a minimum during impacting of the equipment. That is, increased saturation of water in the scale matrix due to the treatment of the scale with water is of considerable benefit in reducing the hazard to personnel that handle the scale.

The water could conceivably be sprayed onto the scale or applied in some other manner, but this is slow and inconvenient and is not preferred. Immersing the scale in water having a temperature greater than about 50° C. has been found to improve the ease of removal of the scale. It is believed that this is because of the thermal transfer from the water to the equipment and the scale or both.

In some cases, the scale will be difficult to remove after a first immersion in liquid nitrogen and water. In those cases, the process should be repeated, though a shorter process cycle should be sufficient for the effective removal of the scale.

In one example, the process of the invention was applied to a section of pipe having an outside diameter of 4½", an inside diameter of 4", a length of about 4" and a 1" thick annulus of radioactive barium sulphate scale deposited around the inside of the pipe. A radioactivity reading next to the scale showed about 500–1000 μRem/hr. Firstly, the pipe and scale were immersed in liquid nitrogen for about 5 minutes until the liquid nitrogen stopped bubbling. Next the pipe and scale were immersed in water at about 15° C. for about 3 minutes, until a layer of ice about ¼" thick formed around the scale and pipe. Next the pipe was removed from the water and impacted with a hammer. The scale cracked and fell off the pipe in ¼" chunks. The pipe showed a radioactivity reading adjacent to the pipe of <20-μRem/hr, compared with a background level of 12μRem/hr. This level is safe enough for surface disposal. The equipment may be re-used in Canada after removal of radioactive scale providing radioactivity levels are near background, and providing the equipment is not rendered useless for some other reason. In some jurisdictions, the equipment may be re-used but any user of this process should check local regulations for any restrictions on the use of the cleaned equipment. The scale itself may be collected in containers, sealed and disposed of in accordance with local and federal regulations for the disposal of hazardous material.

Alternative Embodiments

A person skilled in the art could make immaterial modifications to the invention described and claimed in this patent without departing from the essence of the invention. The invention is believed to be applicable to various kinds of radioactive scale that forms on the inside of equipment in thick layers.

The embodiments of the invention in which an exclusive property or privilege is claimed are defined as follows:

1. A method for removing radioactive scale from fluid carrying equipment comprising the steps of:

applying a cryogenic liquid to the scale and the equipment;

applying an aqueous solution to at least the scale to freeze some of the aqueous solution onto the scale; and impacting the scale or the equipment to remove the scale from the equipment.

2. The method of claim 1 in which applying the cryogenic liquid to the scale includes immersing the scale and the equipment in the cryogenic liquid.

3. The method of claim 2 in which the scale and the equipment are immersed in the cryogenic liquid until both are substantially at the same temperature.

4. The method of claim 2 in which applying an aqueous solution to the scale includes immersing the scale and the equipment in the aqueous solution.

5. The method of claim 2 in which the aqueous solution is water.

6. The method of claim 2 in which the temperature of the scale and the equipment is reduced about to minus 190° C.

7. The method of claim 5 in which the equipment is impacted.

8. The method of claim 5 in which the water is at a temperature above 50° C.

9. The method of claim 5 in which the scale is radioactive barium sulphate.

10. The method of claim 1 in which the scale or equipment is impacted with a solid.

11. A method for removing radioactive scale from fluid carrying equipment comprising the steps of:

immersing the equipment in a cryogenic liquid until the scale and the equipment are about the same temperature;

immersing the scale and the equipment in liquid having a freezing point above the temperature to which the scale and equipment are reduced to allow some of the liquid to freeze onto the scale; and impacting the scale or the equipment to remove the scale from the equipment.

12. The method of claim 11 in which the liquid is an aqueous solution.

13. The method of claim 12 in which the liquid is water.

14. The method of claim 13 in which the scale and the equipment are reduced to a temperature of about minus 190° C.

15. The method of claim 11 in which the scale or the equipment is impacted with a solid.

16. The method of claim 12 in which the scale is barium sulphate.

17. The method of claim 13 in which the scale is barium sulphate.

18. A method for removing radioactive scale from fluid carrying equipment comprising the steps of:

applying a cryogenic liquid to the scale and the equipment;

applying an aqueous solution to at least the scale to freeze some of the aqueous solution onto the scale; and subsequently and independently impacting the scale or the equipment to remove the scale from the equipment.

19. The method of claim 18 in which applying an aqueous solution to the scale includes immersing the scale and the equipment in the aqueous solution.

20. The method of claim 19 in which the aqueous solution is water.

* * * * *